US009474370B2

(12) United States Patent
Troyner et al.

(10) Patent No.: US 9,474,370 B2
(45) Date of Patent: Oct. 25, 2016

(54) DUAL FUNCTION SHELF UNIT

(71) Applicant: Edsal Manufacturing Company, Inc., Chicago, IL (US)

(72) Inventors: Anthony J. Troyner, Shorewood, IL (US); Antonio Luis Escalante, Chicago, IL (US); David J. Wojtowicz, Orland Park, IL (US); Mitch Liss, Northbrook, IL (US)

(73) Assignee: Edsal Manufacturing Company, Inc., Chicago, IL (US)

( * ) Notice: Subject to any disclaimer, the term of this patent is extended or adjusted under 35 U.S.C. 154(b) by 0 days.

(21) Appl. No.: 14/694,273

(22) Filed: Apr. 23, 2015

(65) Prior Publication Data

US 2015/0359331 A1 Dec. 17, 2015

Related U.S. Application Data

(62) Division of application No. 14/189,230, filed on Feb. 25, 2014, now Pat. No. 9,033,164, which is a division of application No. 13/280,646, filed on Oct. 25, 2011, now Pat. No. 8,695,816.

(51) Int. Cl.
*A47F 5/08* (2006.01)
*A47B 43/00* (2006.01)
(Continued)

(52) U.S. Cl.
CPC ..... *A47B 57/402* (2013.01); *A47B 47/0083* (2013.01); *A47B 47/021* (2013.01); *A47B 47/027* (2013.01); *A47B 96/06* (2013.01);
(Continued)

(58) Field of Classification Search
CPC ..... A47B 57/402; A47B 47/0083; A47B 47/021; A47B 47/027; A47B 96/06; A47B 96/14; A47B 96/1408; A47B 96/1441; A47B 47/028; A47B 47/00; A47B 47/02; A47B 57/30; A47B 57/20; A47B 55/00; A47B 57/16; A47B 57/22; A47B 57/50; A47B 96/1416; A47B 96/1433; A47B 96/145; A47B 96/1458; A47B 96/1466; A47B 96/1475; A47B 96/1483; A47B 2096/1491; A47F 5/0807; A47F 5/0823; A47F 5/0815; A47F 5/101; A47F 5/103
USPC ..... 211/191, 192, 13, 190, 187, 57.1, 59.1, 211/94.01, 134, 189, 106.01, 183; 248/231.9, 228.2, 228.1, 227.3, 248/221.12, 222, 11, 222.12, 218.14, 219.1, 248/174, 200, 220.31, 224.51, 225.11; 403/316, 252; 29/513, 521
See application file for complete search history.

(56) References Cited

U.S. PATENT DOCUMENTS 1,462,670 A * 7/1923 Vance ..... A47B 57/16 211/135
2,596,332 A * 5/1952 Flora ..... F16B 37/042 24/293

(Continued)

*Primary Examiner* — Jennifer E Novosad
(74) *Attorney, Agent, or Firm* — Wood Herron & Evans LLP

(57) ABSTRACT

A dual function shelf unit has identical support columns, horizontal shelf-supporting beams adjustably-mounted on the columns for vertical shelf adjustment and one or more hooks also mountable on at least one column. The columns have apertures with complementary apertures having opposed inclined edges for accepting a beam-end bracket from either side of the column and tabs for accepting mounting flanges of hooks. Both beam-end brackets and hooks are each mounted in two vertically-spaced apertures. Vertically adjustable shelf and hook storage is provided.

6 Claims, 11 Drawing Sheets

(51) Int. Cl.

| | |
|---|---|
| ***A47B 47/00*** | (2006.01) |
| ***A47B 57/00*** | (2006.01) |
| ***A47B 47/02*** | (2006.01) |
| ***A47B 96/14*** | (2006.01) |
| ***A47B 57/40*** | (2006.01) |
| ***A47B 96/06*** | (2006.01) |

(52) U.S. Cl.

CPC ..... *A47B96/14* (2013.01); *A47B 96/1408* (2013.01); *A47B 96/1441* (2013.01); *A47F 5/0807* (2013.01)

(56) References Cited

U.S. PATENT DOCUMENTS 2,925,181 A * 2/1960 Saul, Jr. ..... A47B 57/40 211/191
2,925,920 A 2/1960 Skubic
2,937,767 A * 5/1960 Butler ..... A47B 47/021 211/187
3,096,108 A 7/1963 Baybarz
3,127,995 A 4/1964 Mosinski
3,142,367 A * 7/1964 Brown ..... E04B 9/068 403/52
3,228,533 A * 1/1966 Krummell ..... A47B 57/40 211/182
3,240,352 A 3/1966 Baker, Jr.
3,312,488 A * 4/1967 Lickliter ..... E04B 9/067 403/263
3,378,976 A * 4/1968 Meredith, Jr. ..... E04B 9/122 403/145
3,392,848 A 7/1968 McConnell et al.
3,465,895 A 9/1969 Miller
3,480,155 A * 11/1969 Ferdinand ..... A47B 96/1408 211/190
3,501,185 A * 3/1970 Downing, Jr. ..... E04B 9/122 403/252
3,565,474 A * 2/1971 Stumbo ..... E04B 9/10 403/219
3,584,904 A * 6/1971 Lickliter ..... E04B 9/122 403/252
3,647,080 A 3/1972 Denny
3,858,996 A * 1/1975 Jarvis ..... A47B 57/50 24/DIG. 53
3,862,691 A 1/1975 Mori et al.
3,900,111 A 8/1975 Hiler et al.
4,023,683 A 5/1977 Vargo
4,180,003 A * 12/1979 Clement ..... A47B 57/16 108/147.15
4,189,250 A * 2/1980 Abbott ..... A47B 57/402 211/192
4,348,001 A * 9/1982 Baldwin ..... A47F 1/12 108/109
4,382,518 A * 5/1983 Bondoux ..... A47B 57/50 211/192
4,405,052 A * 9/1983 Spiros ..... A47B 57/50 211/187
4,423,817 A 1/1984 Monjo-Rufi
4,425,049 A 1/1984 Travis
4,607,576 A * 8/1986 Kranjec ..... A47B 57/16 108/107
4,618,064 A * 10/1986 Viklund ..... A47B 57/40 211/192
4,729,484 A 3/1988 McConnell
4,928,834 A 5/1990 Neiman
4,996,929 A * 3/1991 Saal ..... A47B 47/021 108/107
5,012,938 A 5/1991 King
5,174,200 A * 12/1992 Jeandel ..... A47B 47/024 108/107
5,190,172 A * 3/1993 Tyson ..... A47B 57/402 211/191
5,350,074 A 9/1994 Rosenband
6,241,109 B1 6/2001 Kautz et al.
6,322,278 B1 * 11/2001 Roberts ..... E04B 9/06 200/335
7,044,312 B2 * 5/2006 Yang ..... A47B 57/40 211/187
8,172,098 B2 5/2012 Eustace et al.
9,033,164 B2 * 5/2015 Troyner ..... A47B 57/402 211/103
2004/0045921 A1 3/2004 Muller
2008/0272676 A1 11/2008 Eustace et al.
2009/0145867 A1 6/2009 Apgood, II et al.

* cited by examiner

DUAL FUNCTION SHELF UNIT

This application is a divisional application of U.S. patent application Ser. No. 14/189,230 filed Feb. 25, 2014, now allowed, and issued on May 19, 2015 as U.S. Pat. No. 9,033,164, which was a divisional of U.S. patent application Ser. No. 13/280,646, filed Oct. 25, 2011, now U.S. Pat. No. 8,695,816 issued Apr. 15, 2014, both of which applications are expressly incorporated herein.

FIELD OF THE INVENTION

This invention relates to steel shelving and more particularly to a steel shelving unit providing both adjustable shelving as well as accessory functions for holding items other than on a shelf.

BACKGROUND OF THE INVENTION

Steel shelving units comprising horizontal shelf-supporting beams with ends adjustably connected to vertical support columns for shelf height adjustment are known. While such units are very useful, it is desirable to provide such beams with improved structures for converting such beams to such columns. As well, it is frequently desirable to provide additional capacity in such units for holding items other than by positioning on the shelves themselves. Additionally, it is desired to provide for vertical adjustability of shelf unit accessories providing such additional capacity.

SUMMARY OF THE INVENTION

To these ends, a preferred embodiment of the invention includes an improved support column for a shelving unit with provisions for adjustably mounting shelf-supporting beams and accessories, such as a removable, adjustable, hook accessory for hanging items for storage or display, other than on the shelves of the unit.

Accordingly, an improved support column according to a preferred embodiment of the invention includes a plurality of perforations or apertures in the column face and which operably accommodate end brackets of a horizontal shelf-supporting beam as well as removable accessories, such as hooks which cooperate with the apertures.

Each perforation in the column is defined by a plurality of edges which define tapered support surfaces for cooperating with beam end brackets to adjustably mount the brackets in position up and down the columns. Transverse edges of the perforations or apertures are preferably bent or curved to support a bracket component of an accessory such as a hook. Both the beam-end bracket and the hook bracket interface with two adjacent, vertically-spaced, apertures in the column for securely holding them in a selected vertical position on the column.

Preferably the perforations are symmetrical on the column face, and centrally disposed therein so a column can be used on both right and left sides of the shelving unit with all columns in the unit (typically four of them) preferably identical.

The beam-end brackets are each angular or L-shaped, with one leg welded or affixed to the beam, and the other leg for lying adjacent to or on the column face over at least part of the column aperture. This other bracket leg preferably has tabs for extending into and engaging a tapered edge of each of two column apertures, one above the other, to hold the bracket and its fixed beam in a fixed, but removable position at selected vertical positions on the column.

The hook bracket has extensions, one fitting over a curved portion of an upper aperture on the column and another over a similar curved portion of a next lower aperture for securing the hook in the column face at a selected vertical position. A tab, upwardly extending from the hook bracket, engages a rear side of the column face at the upper aperture to facilitate mounting ad holding the hook and accessory thereon.

Other accessories, similarly mountable to the columns, and other than hooks, are contemplated.

Accordingly, the invention provides a shelving unit having vertically adjustable shelf-supporting beams, as well as vertically adjustable accessories, both mountable on a supporting column at variable, selected, vertical positions. Improved perforation on the faces of the columns facilitates both beam and accessory mounting.

These and other objectives and advantages will become readily apparent from the following detailed description of a preferred embodiment of the invention and from the drawings in which:

DETAILED DESCRIPTION OF THE INVENTION

Figure 1:
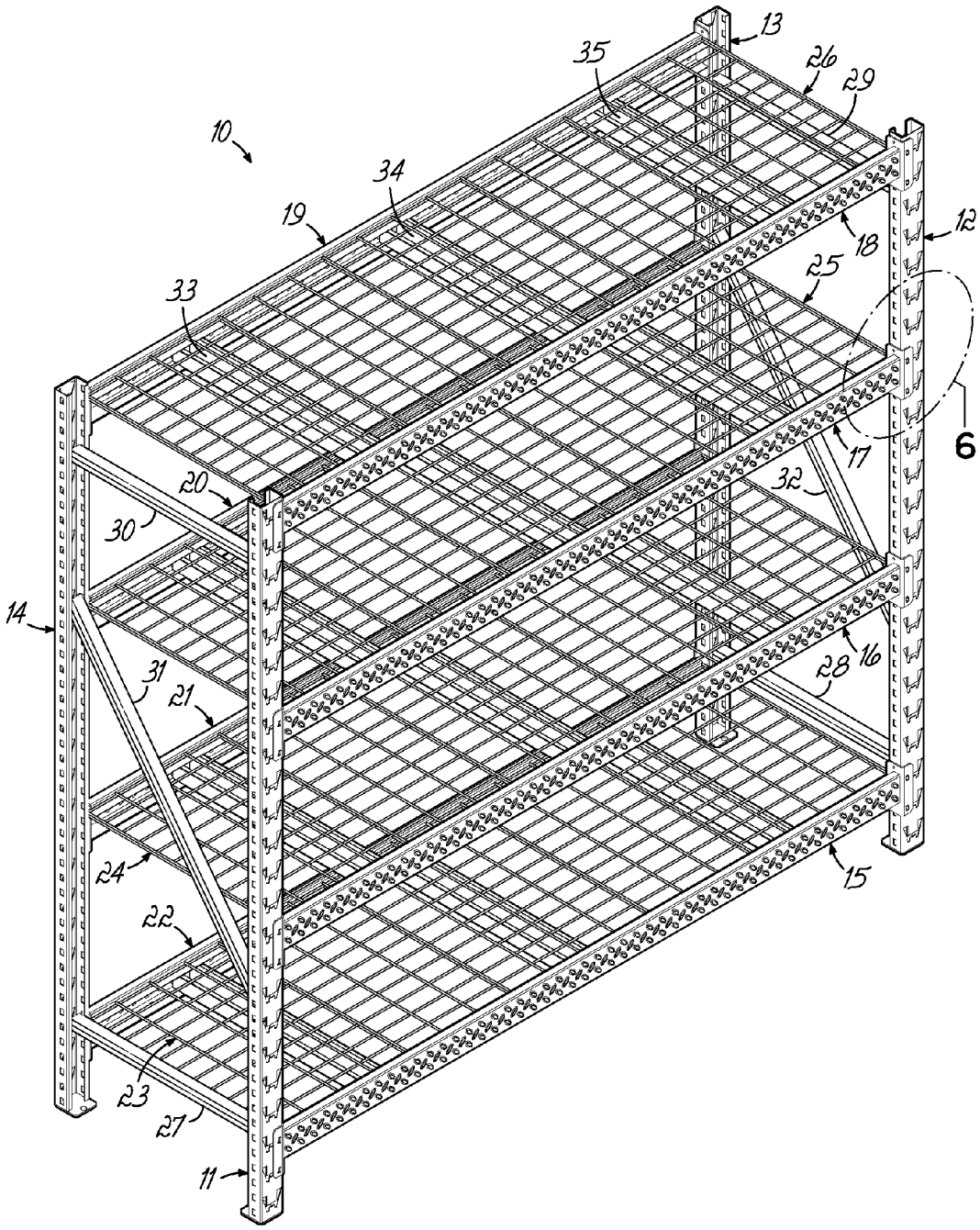
FIG. 1 is a front isometric view of the overall shelving unit of the invention.

Turning now to the drawings, there is shown in FIG. 1 an isometric view of a dual function shelf unit 10 according to one embodiment of the invention. Shelf unit 10 includes four vertical support columns 11-14, a plurality of horizontal shelf-supporting beams 15-22, a plurality of shelves 23-26 which are shown as wire-formed shelves but could be in other wire patterns, of solid material, of grate or other patterns or of any suitable shelf configuration, each supported by one of beams 15-18 and one of beams 19-22, respectively.

A plurality of horizontal braces 27-30 extend between respective columns 12, 13 and 11-14 as shown, as well as a plurality of slanted braces 31, 32 as shown.

Figure 4:
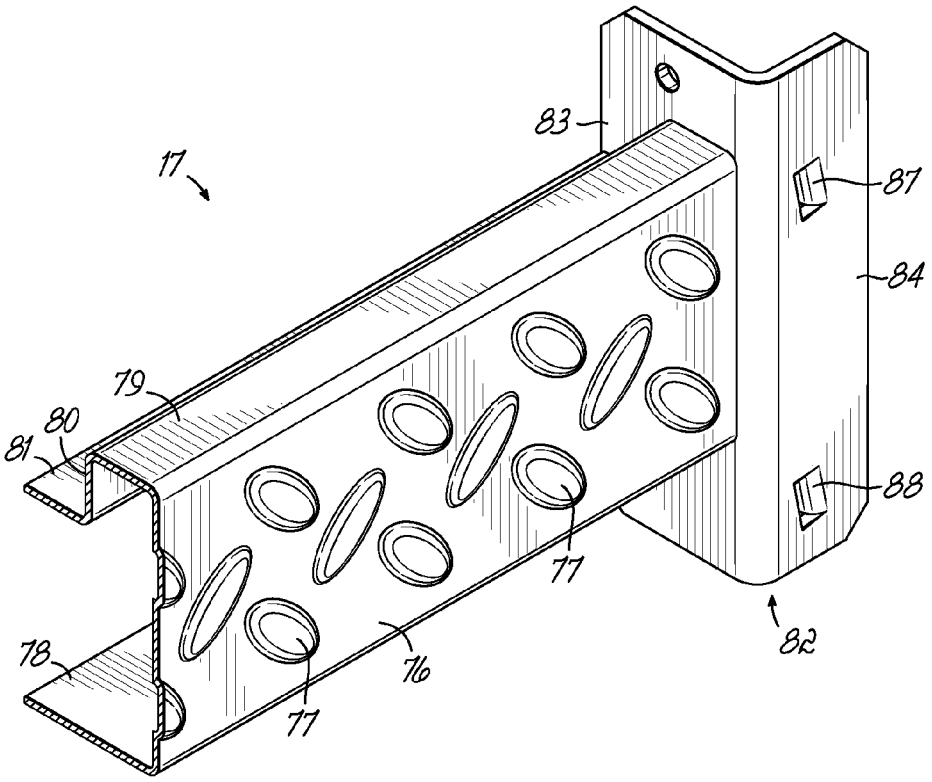
FIG. 4 is a fragmentary isometric cross-sectional view generally taken along lines 4-4 of FIG. 3.
Figure 5:
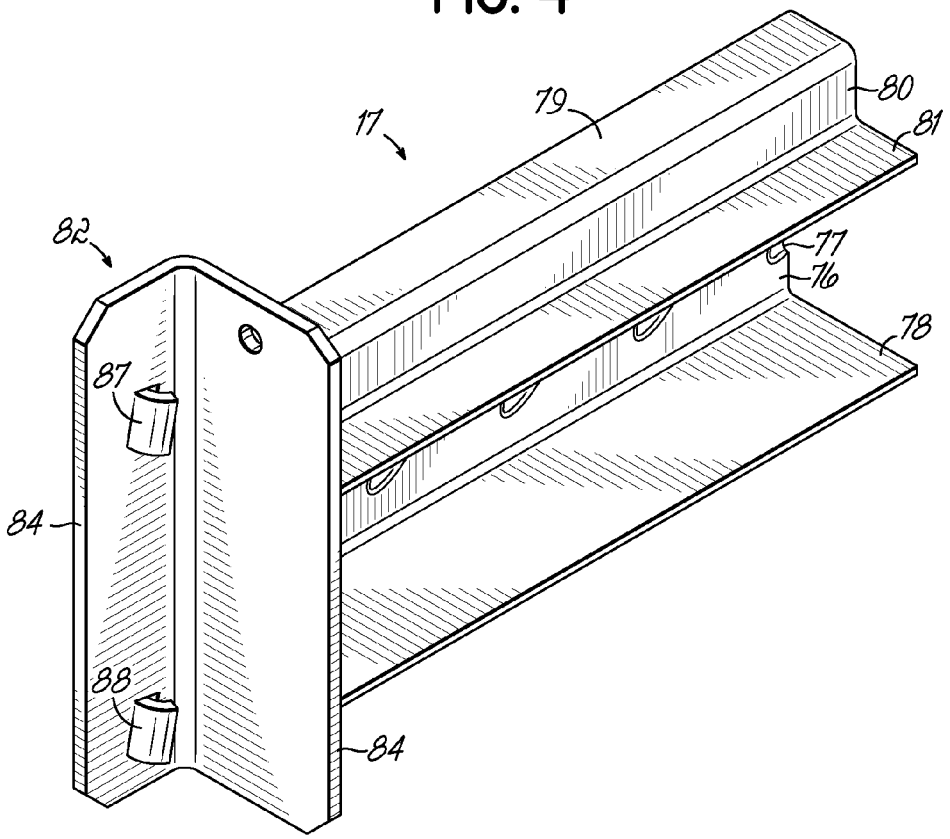
FIG. 5 is a rear isometric view of the fragmentary isometric cross-sectional view of FIG. 4.
Figure 6:
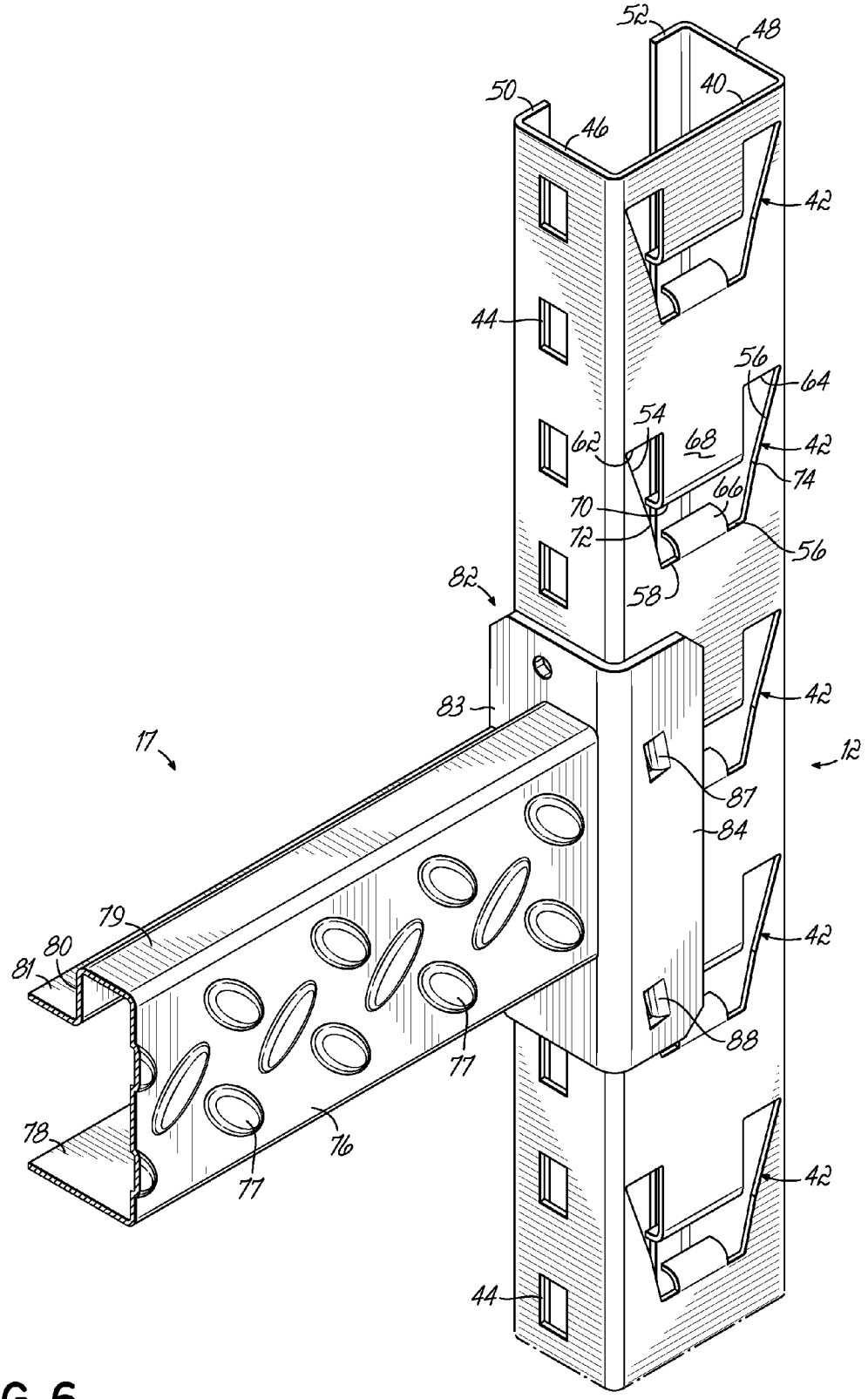
FIG. 6 is an enlarged isometric view of the encircled area of FIG. 1.

Optionally, a plurality of preferably identical tie bars 33, 34, 35 extend between respective ones of the front beams 15-18 and rear beams 19-22 to support shelves 23-26 respectively, these bars 33-35 extending respectively under each shelf and supported on the respective horizontal beams, particularly on flange 78 (see FIGS. 4-6).

Figure 2:
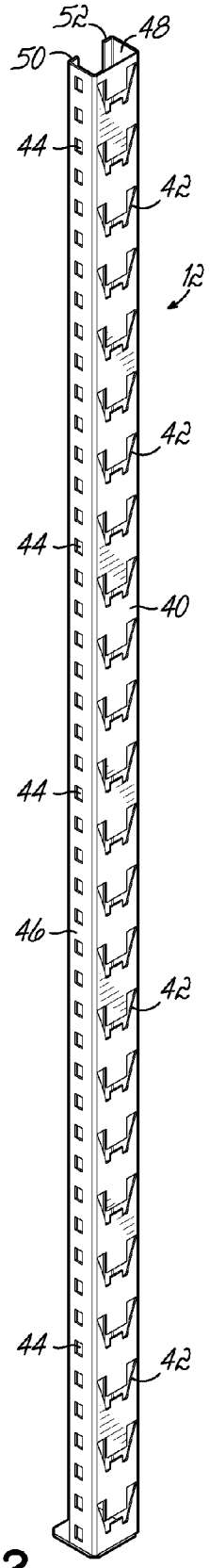
FIG. 2 is a front isometric view of a column of the invention.
Figure 9:
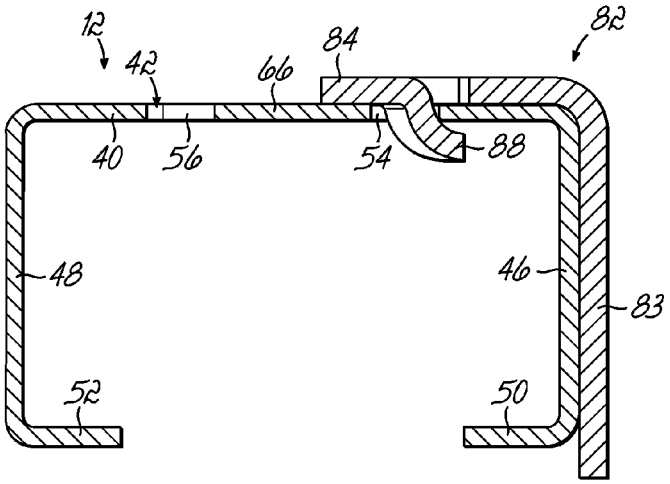
FIG. 9 is a cross-sectional view taken along lines 9-9 of FIG. 8.

A column 12 is illustrated in FIG. 2, column 12 being preferably identical to columns 11, 13, 14 and thus only one being described in detail, each with preferably like parts. Identical construction allows a column to be used at any corner position in unit 10, Columns 11-14 are in a C-shaped cross-sectional configuration (see also FIGS. 6, 7, 8, 10-13). Each column thus has a face 40, a plurality of symmetrical apertures 42 in the face 40, and a plurality of rectangularly-shaped apertures 44 in each leg 46, 48. Each leg terminates along its legs 46-48 with its flanges 50, 52 completing configuration of column 12 (see FIGS. 2, 6 and 9, for example).

Details of apertures 42 are perhaps best seen in FIGS. 6-13. Referring first to FIG. 6, each aperture 42 is preferably identical to each other aperture 42 in the respective columns. Each aperture 42 is oriented one above the other in the columns, equally spaced vertically and aligned centrally and symmetrically in column face 40, as shown. Each aperture is defined in part by edges 54, 56, tapering or inclined from a bottom edge 58, 60 upwardly and outwardly in face 40 to upper edges 62, 64.

A curved tab 66 extends upwardly between bottom edges 58, 60 and is turned or curved inwardly from face 40. A second tab 68 extends downwardly as part of face 40 between edges 54, 56 and has an inwardly curved tab end 70, as shown.

Tapering or inclined edges 54, 56 may be continuously straight, or may define slightly different angles, such as at breaks 72, 74 as illustrated in FIG. 6 such that upper regions of edges 54, 56 incline outwardly in face 40 at a slightly greater angle than lower regions of those edges to facilitate initial bracket engagement.

Figure 3:
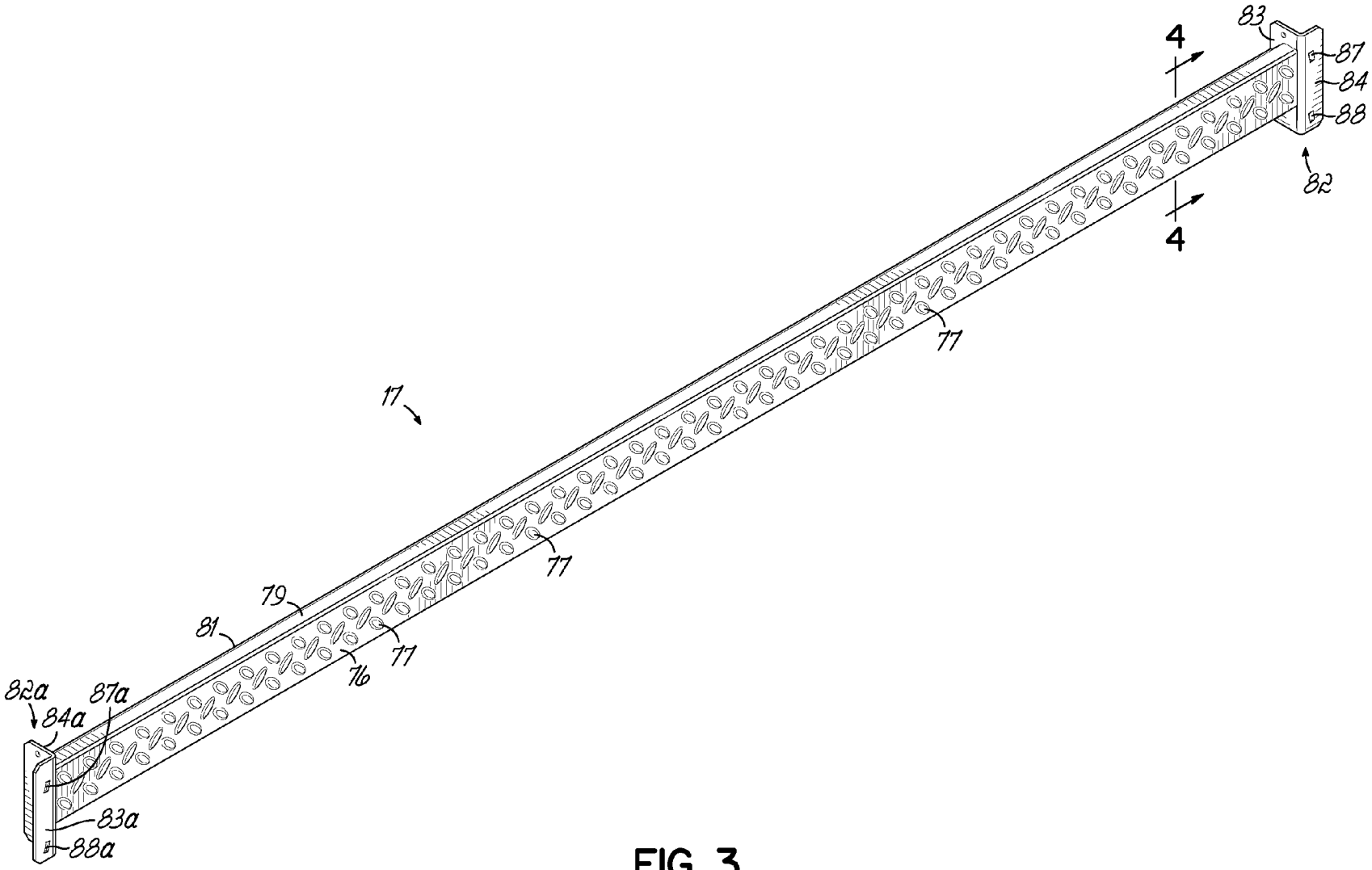
FIG. 3 is a front isometric view of a horizontal shelf-supporting beam of the invention.

Horizontal beams 15-22 are, like columns 11-14, each preferably identical to each other so they can be interchangeably used in shelf unit 10. Only one exemplary beam 17 will be described in detail, With initial reference to FIGS. 3-5, an elongated shelf support beam 17 includes a preferably embossed face 76, having a plurality of outstanding ornamental projections 77 of any suitable form embossed, pressed from or otherwise defined in face 76.

Beam 17 is defined by a lower, rearwardly extending flange 78, a first rearward extending upper flange 79, a return 80 and a final rearwardly extending shelf-supporting flange 81. Other beam configurations may be used but this beam provides both shelf-supporting flange 81 and lower, tie-bar supporting flange 78 as will be described.

To an end of beam 17 is welded (or otherwise fixed) an L-shaped bracket 82 having a rearwardly extending leg 83 and a front leg 84. A bracket 82*a*, which is essentially a mirror image and otherwise identical to bracket 82, is fixed to the other end of beam 17 and is otherwise similar to the bracket 82. Similar parts of the respective brackets are numbered with a suffix "a". Legs or faces 84, 84*a* of brackets 82, 82*a* are provided with punched-out upper and lower locking tabs 87, 88, 87*a*, 88*a* formed at an angle in leg 84, 84*a*, respectively (FIGS. 4, 5). As will be described, these tabs serve to engage and interface with inclined edges 54 of adjacent apertures 42 (see FIGS. 8, 9) holding and locking the brackets 82 to column 12. Similar tabs 87*a*, 88*a* will engage and interfere in similar fashion with inclined edge 56 of apertures 42 in another column 11 at the other end of the beam to hold and lock the bracket 82*a* and beam 17 to that column 11.

Figure 7:
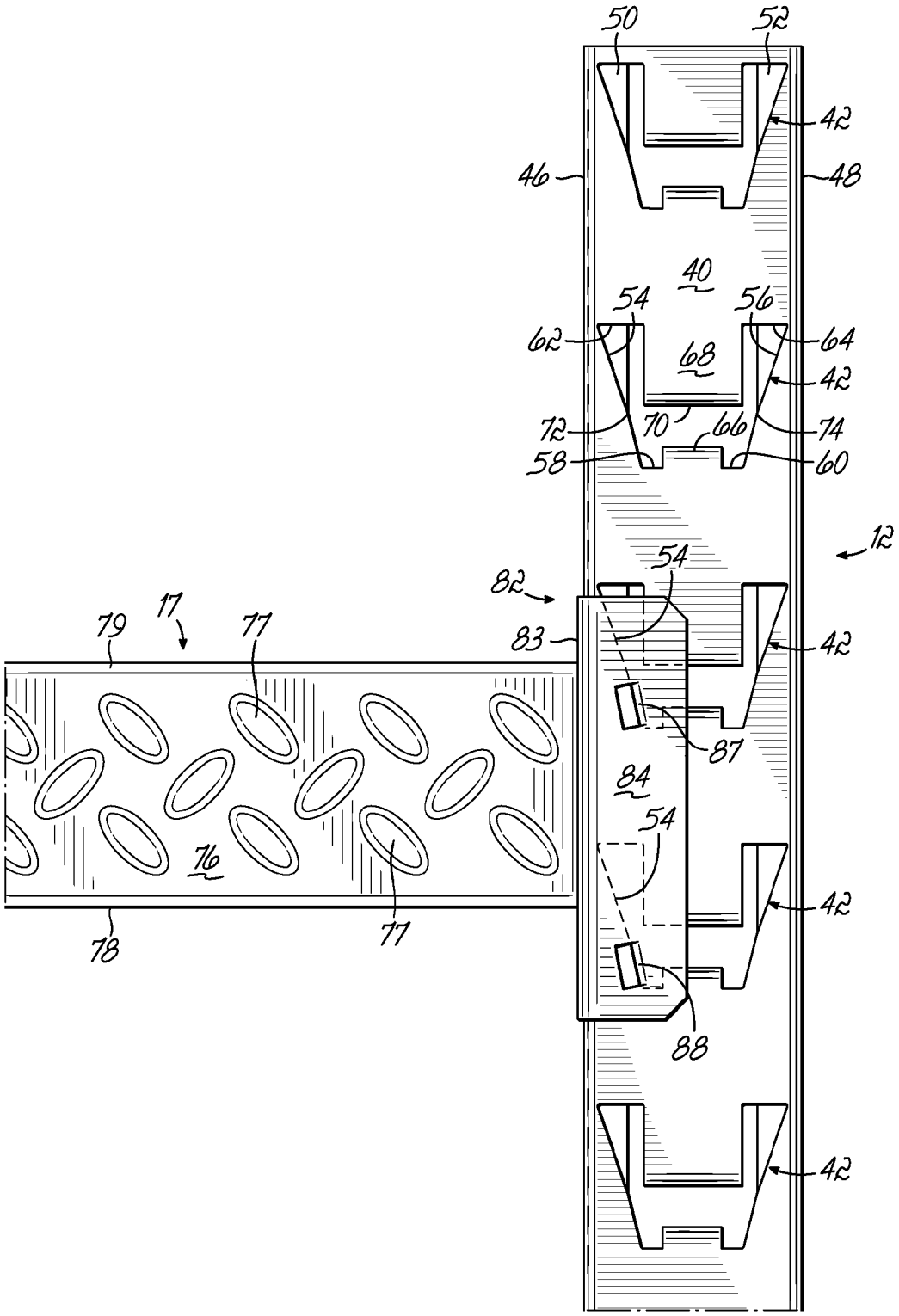
FIG. 7 is a front partial view of the beam and post of FIG. 6.
Figure 8:
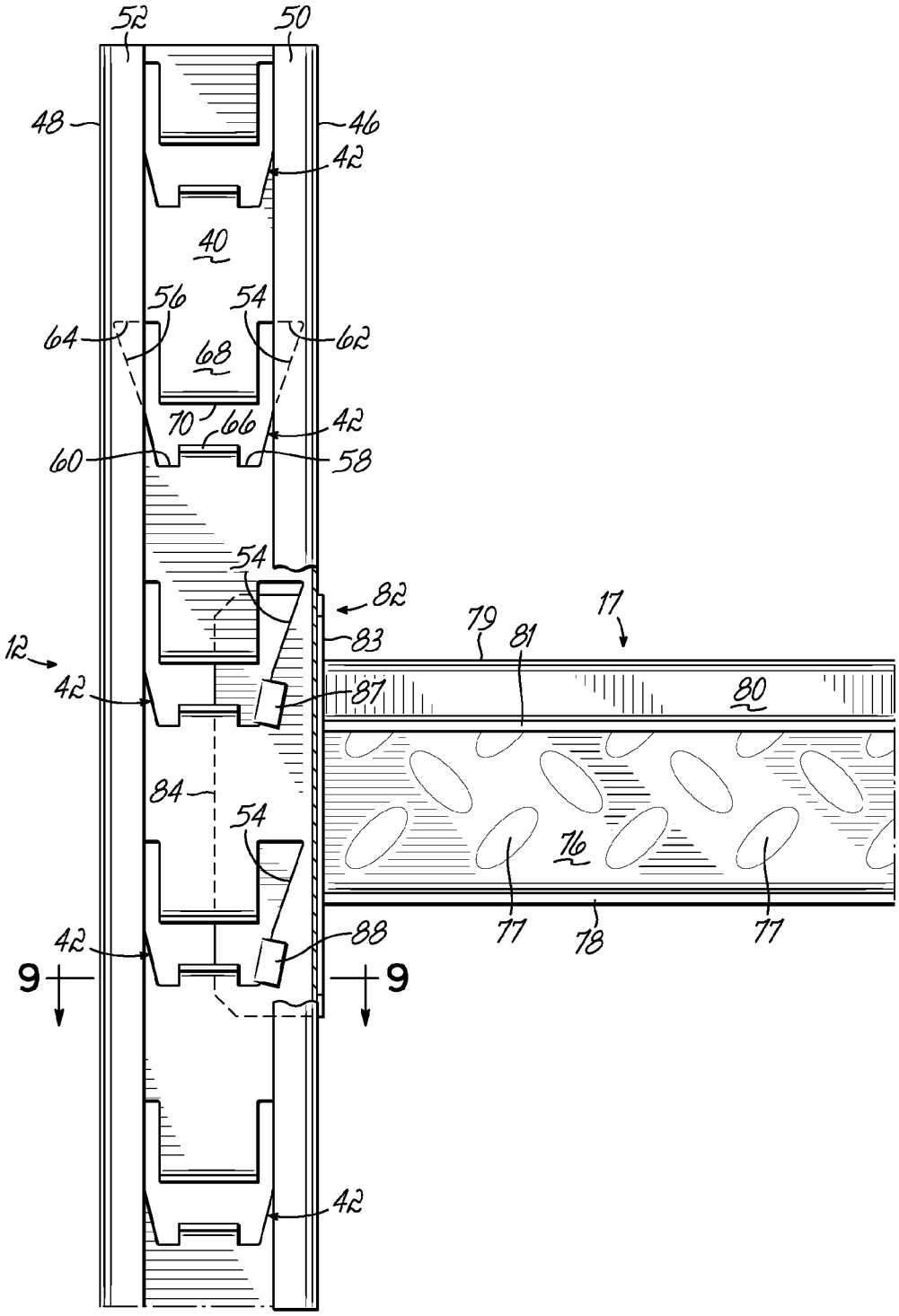
FIG. 8 is a rear view of the partial beam and post of FIG. 7.

FIGS. 6-8 further illustrate the interconnected relationship of a beam 17 to a column 12. The other beam end is supported and locked such as on a column 11 by a bracket 82*a* operational in a similar fashion.

In FIG. 6, bracket 82, via tabs 87, 88 is locked onto column 12. For example, the beam 17 and its fixed bracket are oriented proximate vertically adjacent apertures 42 in column 12, with tabs 87, 88 initially proximate upper ends of apertures 42 so the tabs can be inserted into the apertures. When leg 82 is against face 40, the bracket (and beam) is moved downwardly, tabs 87, 88 engaging and fitting around inclined edges 54 in the respective apertures. The distance between tabs 87, 88 and the leg 82 of the bracket causes, as the bracket moves downwardly, the tabs 87, 88 and leg 84 to be frictionally wedged onto column 12, the engagement of respective tabs 87, 88 with edges 54 providing frictional, locking engagement of bracket 82 and beam 17 to column 12. Similar complementary action of tabs 87*a* and 88*a* with inclined edges 56 of vertically-adjacent apertures 42 in column 11 secures the other end of the beam in vertically-coordinated position so the beam 17 is horizontally supported across and between columns 11 and 12 as described.

The vertical locations of the beams 15-22 can be set on the columns as desired to provide the eventually desired spacing between any shelves as described in unit 10.

It will be further appreciated that the frictional interface between two respective apertures 42 in each column, and the single complimentary brackets at each end of the beam strengthens and rigidifies any tendency of the columns connected by the beams to "rack", move or tilt toward or away from one another, resulting in a very strong, rigid unit 10 construction. This benefit is, in part, also provided by the engagement of the inner faces of legs 83, 84 with the respective leg 46 and face 40 of column 12 as well as tabs 87, 88 and inclined aperture edge 54. Complementary engagement of complementary parts of bracket and column at the other beam end provide the same result.

Accordingly, it will be appreciated that a shelf unit 10, as described above, provides a rigid shelving function for a variety of applications.

In a further embodiment of the invention, a further support function is provided by the addition of an accessory which provides a further article support or hanging function shelving unit 10.

Figure 10:
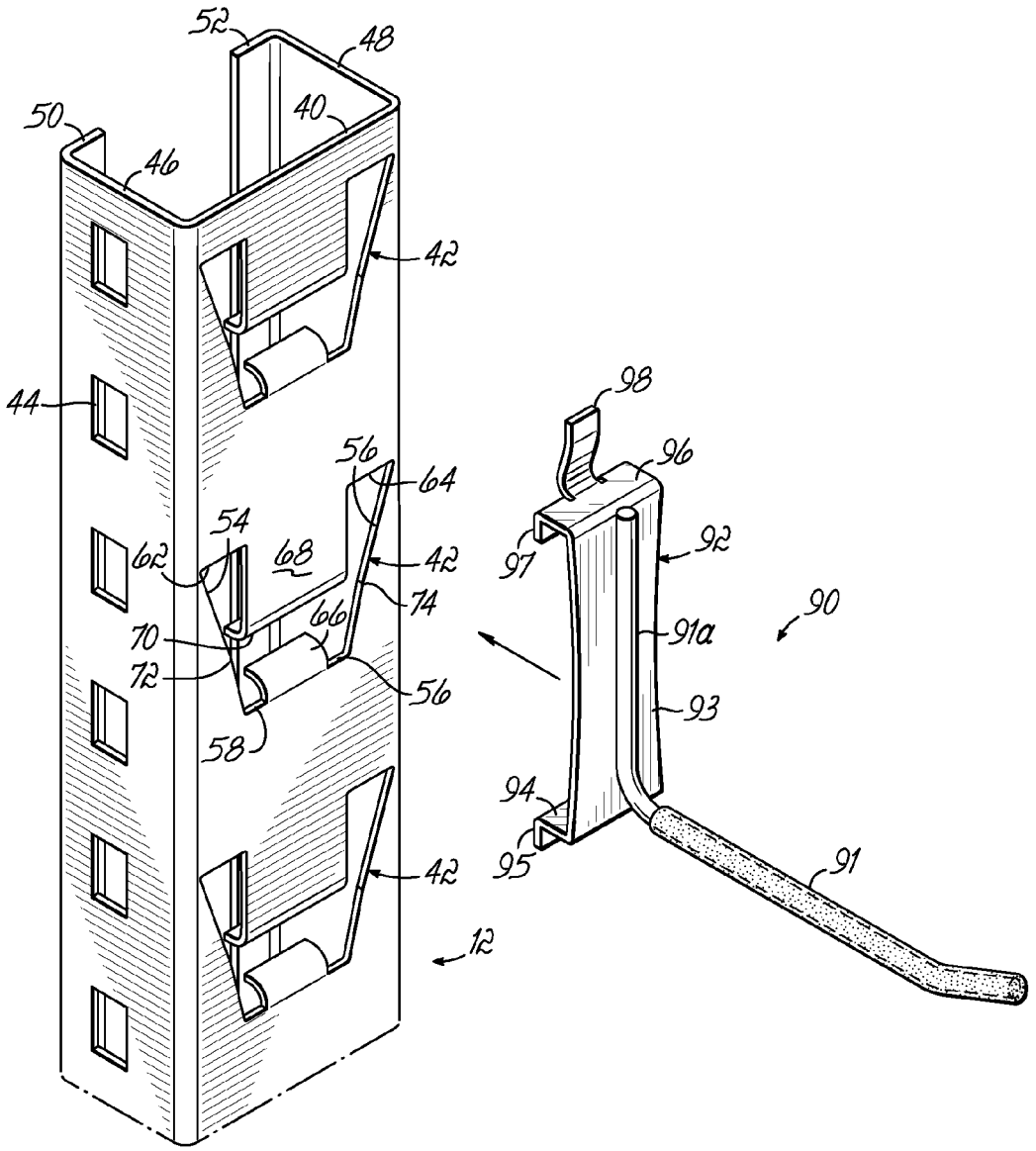
FIG. 10 is a front isometric view of a hook accessory spaced from a column shown in partial view.

This additional embodiment is illustrated in FIGS. 10-13 of the drawings, wherein an accessory hook 90 is provided for use on a column, such as a column 12 as described above. In FIG. 10, hook accessory 90 includes a hook member 91 preferably rigidly-mounted at shank 91*a* to a hook bracket 92. Bracket 92 includes a face surface 93, a lower flange 94 with a depending tab 95, and upper flange 96 with a downwardly depending tab 97, and an upwardly extending locking tab 98.

Figure 11:
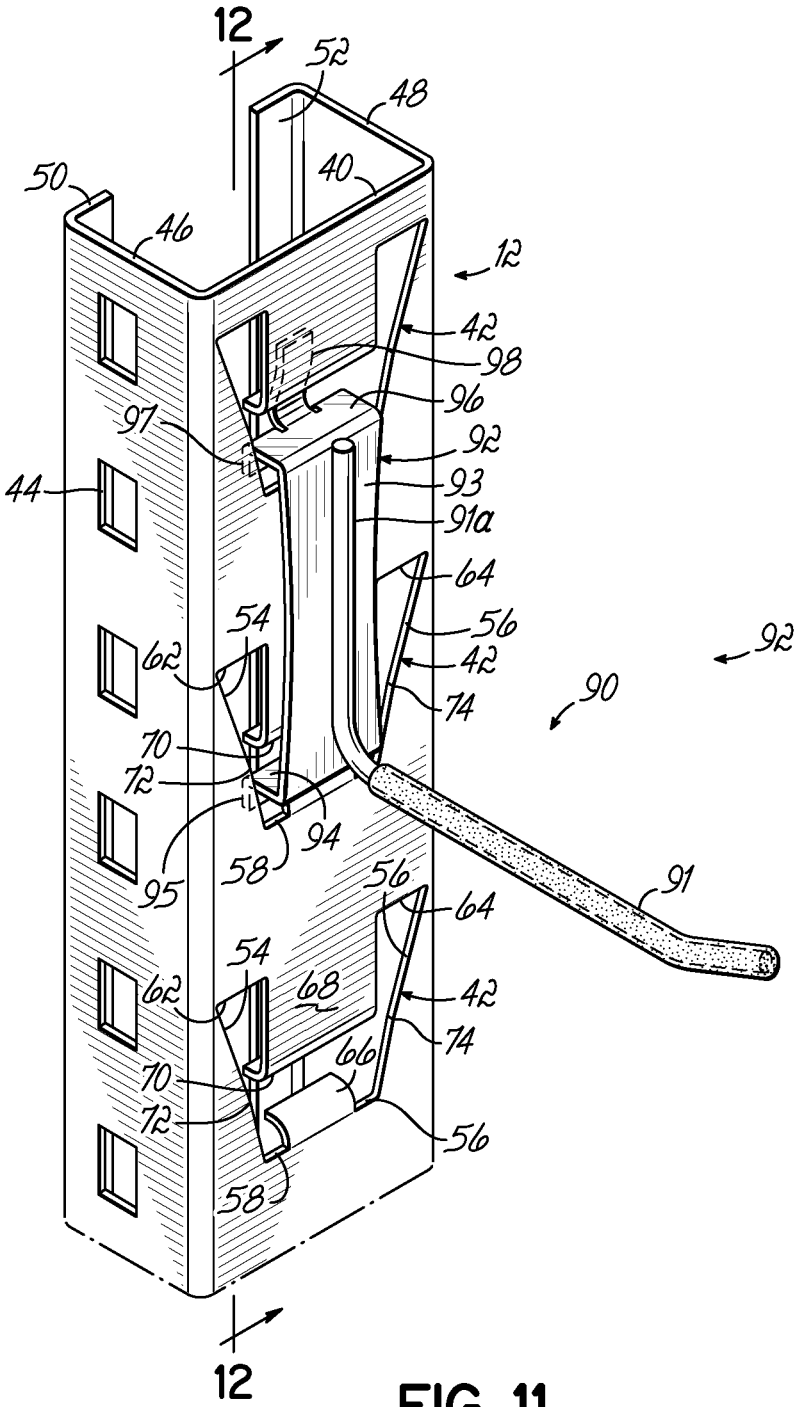
FIG. 11 is an isometric view as in FIG. 10, but showing the hook accessory mounted to the column.

FIG. 10 illustrates a column 12 and a hook accessory 90, not yet assembled and FIG. 11 illustrates a hook accessory 90 attached to a column 12. In FIG. 11, it is noted that flanges 94 and 96 of hook accessory 90 rest on the curved tabs 66 respectively of vertically-oriented adjacent apertures 42 in face 40 of column 12. Tabs 97, 95 prevent hook accessory 90 from being pulled outwardly, away from column 12. Locking tab 98 prevents removal of hook accessory 90 horizontally and forwardly of column 12 since it engages or is in close blocking proximity to curved end 70 of tab 68 if moved directly forwardly.

Figure 12:
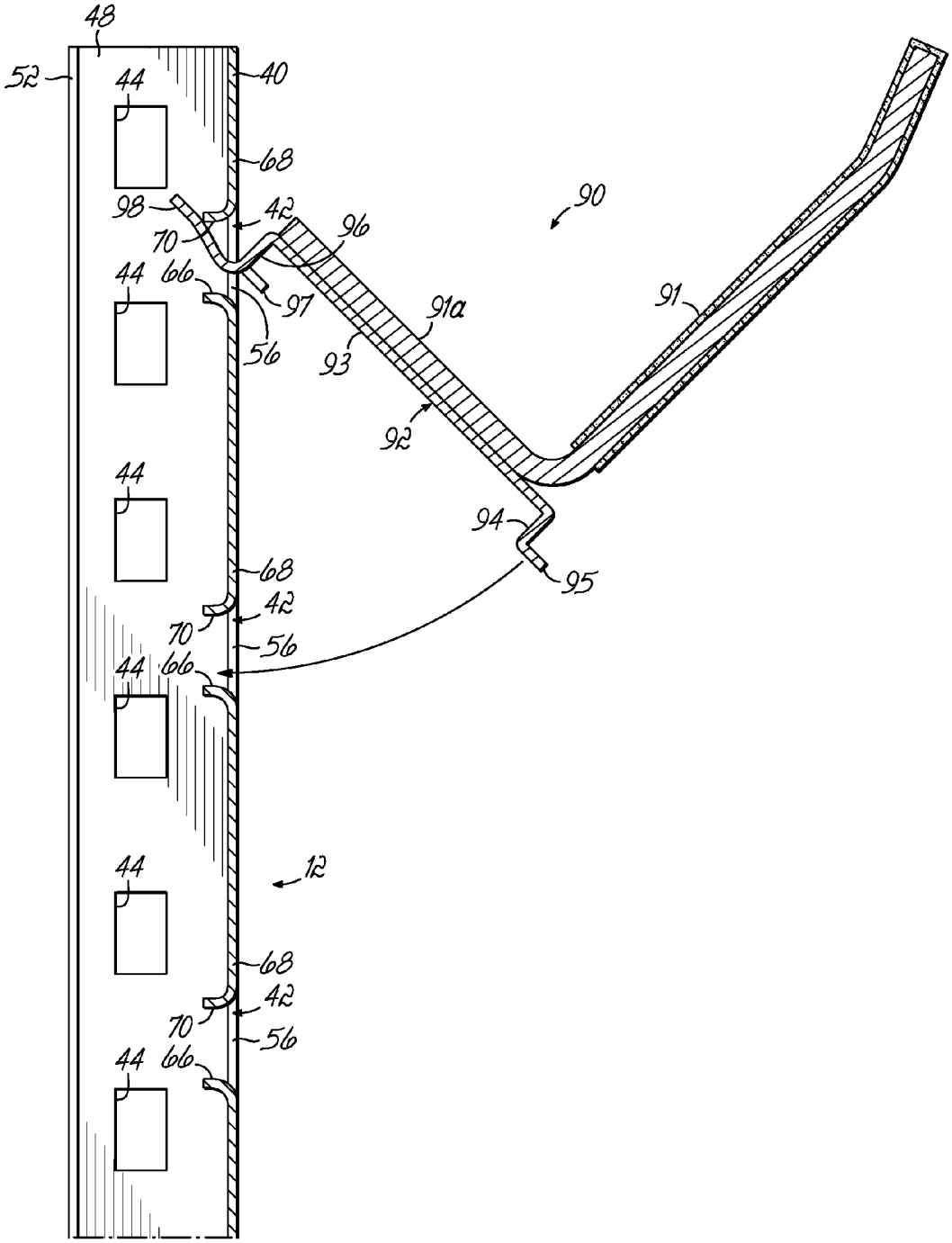
FIG. 12 is a cross-sectional view taken along lines 12-12 of FIG. 11 but showing the respectively rotated hook accessory being partially mounted to a column.
Figure 13:
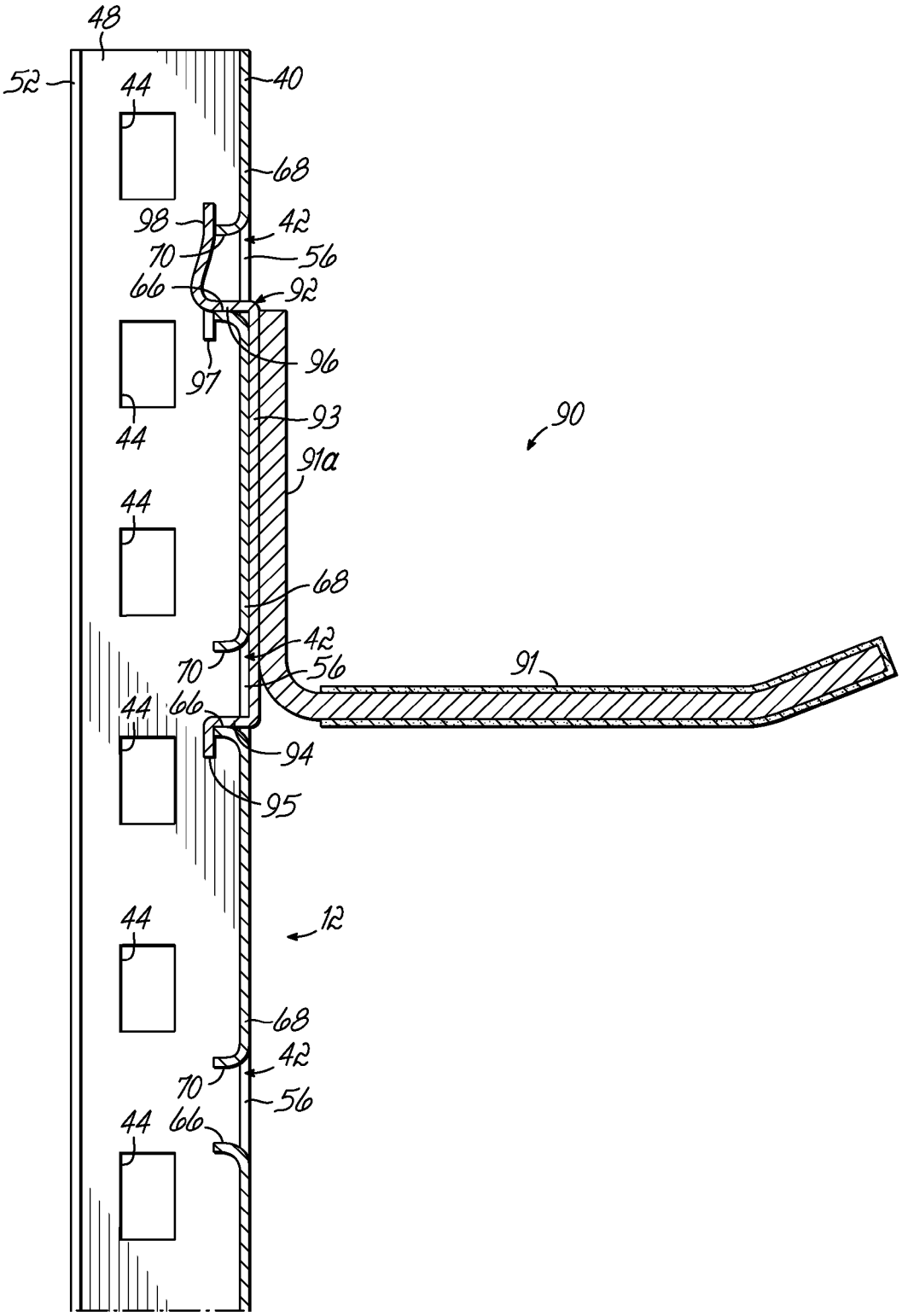
FIG. 13 is a view similar to FIG. 12 but showing the hook accessory mounted to the column.

Referring to FIGS. 12 and 13, FIG. 12 illustrates the preferred motion for attaching accessory hook 90 to a column such as 12. In use, the upper end of hook 90 is inserted into an upper aperture 42, tab 98 extending therein below, then behind end 70 of tab 68 in the aperture. Once the upper end of accessory hook 90 is extended into upper aperture 42, the lower end of bracket 92 can be rotated into a lower aperture 42 and then bracket 92 lowered so tabs 97, 95 are locked behind the curved tab ends 66, respectively of the vertically-adjacent apertures as in the cross-sectional view of FIG. 13.

Hook accessory 90 is thus removably but securely mounted at selected vertical positions up and down column 11, 12 and others, providing for additionally supporting functions for a variety of items on shelving unit 10. In this embodiment, the hooks can be selectively spaced along the entire lengths of the columns excepting at the same position of the brackets 82, 82*a* on the columns for the horizontal shelf-supporting beams.

Vertically-adjustable storage is thus not limited to the shelves only but includes the additional function of hanging items suitably on vertically-adjustable hooks.

It will be appreciated that other storage or hanging accessories can be similarly attached to the columns to provide additional hanging or storage functions.

What is claimed is:

1. In a vertical column apparatus for use in a shelf unit, a column, a plurality of apertures in a face of said column, said apertures each defined in said face in part by upwardly and outwardly inclined opposed edges, said opposed edges respectively separated at top ends thereof by a depending first tab therebetween defined in said face and at lower ends by an upstanding second tab, oriented therebetween, and defined in said face, wherein each of said first and second tabs have a free distal end and said respective free distal ends of each of said tabs are curved in a direction inwardly of said face.

2. In a vertical column apparatus as in claim 1, wherein said column comprises a C-shaped configuration in cross-section having two legs and portions of said face oriented therebetween, said apertures aligned centrally in said face portion, said tabs in said apertures aligned centrally in said face, and oriented one above another.

3. In a vertical column apparatus for use in a shelf unit, a column, a plurality of apertures in a face of said column, said apertures each defined in said face in part by upwardly and outwardly inclined opposed edges, said edges respectively separated at top ends thereof by a depending first tab therebetween defined in said face and at lower ends by an upstanding second tab, oriented therebetween, and defined in said face, wherein said apertures are oriented one above the other, and further including in combination therewith at least one hook apparatus including a bracket having respective upper and lower flanges engaging respective second tabs of respective vertically-spaced apertures.

4. In a vertical column apparatus as in claim 3 further including a tab extending downwardly from each said flange.

5. In a vertical column apparatus as in claim 4 further including a locking tab extending upwardly from said upper flange.

6. In a vertical column apparatus as in claim 5, wherein said locking tab is engageable with said first tab.

* * * * *